United States Patent [19]

Würfel et al.

[11] Patent Number: 4,621,970

[45] Date of Patent: Nov. 11, 1986

[54] APPARATUS FOR REMOVING REELS WITH EXPOSED ROLL FILMS FROM CARTRIDGES

[75] Inventors: Reinhart Würfel, Munich; Helmut Zangenfeind, Puchheim; Günther Dömges, Deisenhofen; Raimund Kugel, Munich, all of Fed. Rep. of Germany

[73] Assignee: Agfa-Gevaert Aktiengesellschaft, Leverkusen, Fed. Rep. of Germany

[21] Appl. No.: 778,609

[22] Filed: Sep. 20, 1985

[30] Foreign Application Priority Data

Oct. 9, 1984 [DE] Fed. Rep. of Germany ..... 3437045

[51] Int. Cl.[4] ..... B65D 49/12

[52] U.S. Cl. ..... 414/412; 414/417

[58] Field of Search ..... 414/417, 403, 411, 412

[56] References Cited

U.S. PATENT DOCUMENTS 4,076,135 2/1978 Klose ..... 414/403

4,171,055 10/1979 Lindgren ..... 414/412

FOREIGN PATENT DOCUMENTS 2253707 7/1976 Fed. Rep. of Germany .

2335453 12/1982 Fed. Rep. of Germany .

*Primary Examiner*—Leslie J. Paperner

*Assistant Examiner*—Stuart J. Millman

*Attorney, Agent, or Firm*—Peter K. Kontler

[57] ABSTRACT

Apparatus for expelling reels with convoluted exposed roll films from successive film cartridges has a gate which supports a cartridge at an opening station between an axially movable mandrel and an axially movable pusher. A holder with four or more equidistant idler wheels having sharp edges is adjacent to one end of the shell of the cartridge which is located between the mandrel and the pusher to hold the shell against axial movement with the pusher when the latter is shifted axially toward the mandrel to bear upon the core of the reel in the cartridge and to expel the reel as well as one end wall of the cartridge from the shell while the mandrel transmits or is ready to transmit torque to the core in a direction to wind the film onto the core. The idler rollers are thereupon disengaged from the shell and the gate is retracted so that the shell can leave the opening station by gravity before the next cartridge enters the opening station by gravity feed.

20 Claims, 6 Drawing Figures

12
11
13
17b
17
13b
17a
13a
18
20b
20a
21
20
V
3c
9
28
3e
20c
22
8
1
1a
1b
1c
1d
10
4a
7
103
IV
29
16b
16
16a
3
3b
15
14
19

APPARATUS FOR REMOVING REELS WITH EXPOSED ROLL FILMS FROM CARTRIDGES

CROSS-REFERENCE TO RELATED CASES

The apparatus of the present invention is in part identical with those disclosed in the commonly owned copending patent application Ser. Nos. 778,611 and 778,612 filed Sept. 20, 1985.

BACKGROUND OF THE INVENTION

The present invention relates to improvements in apparatus for manipulating containers for photographic roll films, especially exposed photographic roll films, and more particularly to improvements in apparatus for expelling or removing reels with exposed photographic roll films from cassettes, cartridges or analogous containers. Still more particularly, the invention relates to improvements in apparatus for removing reels with exposed photographic roll films from containers or cartridges of the type wherein the reel is confined in a substantially cylindrical shell having a substantially tangentially extending mouth which is flanked by two sealing strips or lips and defines a path for longitudinal movement of the photographic film from or into the interior of the shell. Cartridges of the just outlined character further comprise pairs of end walls which are riveted or otherwise sealingly secured to the end portions of the shell and have centrally located apertures for the core of the reel.

German Pat. No. 23 35 453 discloses an apparatus which comprise two clamping jaws disposed opposite each other and having arcuate portions which are movable into engagement with the shell of a cartridge containing a reel with exposed photographic roll film thereon. The curvature of the engaging portions of the jaws matches the curvature of the shell of the cartridge, and the two engaging portions together define a substantial part of a complete circle. One cover or end wall of the cartridge can be separated from the remainder of the cartridge by a fork-shaped tool which is movable radially of the cartridge and is thereupon shifted axially to engage the one end wall at two spaced-apart locations and whose prongs are in substantially linear contact with the end wall. A drawback of such apparatus is that the area of contact between the jaws and the shell of the cartridge is relatively small so that, if the shell is to be held against movement with the tool, the jaws must be urged into a pronounced deforming engagement with the shell which, in turn, interferes with orderly and predictable separation of the one end wall for the purpose of permitting extraction or expulsion of the reel with convoluted roll film from the interior of the shell. Thus, the force with which the shell can be engaged by the jaws cannot be increased at will because excessive deformation of the shell would prevent expulsion or extraction of the reel.

In accordance with a different prior proposal, the apparatus for removing reels with exposed roll films from the shells of cartridges comprises a bifurcated holder which engages the shell of a cartridge at an opening station, and two bell crank levers with grippers having sharp edges serving to separate one end wall from the shell of the cartridge. Such apparatus share the drawbacks of the aforediscussed patented apparatus, namely they cannot ensure predictable separation of one end wall from each and every type of cartridges which are presently used for confinement of photographic roll films.

OBJECTS AND SUMMARY OF THE INVENTION

An object of the invention is to provide a novel and improved apparatus for removing reels with exposed photographic roll films from cartridges or analogous containers with a higher degree of predictability than heretofore known apparatus.

Another object of the invention is to provide the apparatus with novel and improved means for expelling one end wall of the container from the shell and for simultaneously expelling the reel from the interior of the shell.

A further object of the invention is to provide the apparatus with novel and improved means for reliably gripping or holding the shell at the opening station in such a way that the deformation of the shell is not excessive and the properly gripped shell does not interfere with expulsion of the reel from its interior.

An additional object of the invention is to provide the apparatus with novel and improved means for positioning successive containers at the opening station and with novel and improved means for feeding successive containers to such positioning means.

Still another object of the invention is to provide the apparatus with novel and improved means for manipulating the holder for the shell of the container at the opening station.

A further object of the invention is to provide the apparatus with novel and improved means for holding the reel against a change of orientation during its expulsion from the interior of the shell at the opening station.

An additional object of the invention is to provide a novel and improved method of predictably, rapidly and safely expelling reels with rolls of convoluted photographic film thereon from successive cartridges or analogous containers at an opening station.

Another object of the invention is to provide an apparatus which can expel reels with rolls of photographic film from a wide variety of containers irrespective of the magnitude of force with which the end walls of such containers are attached to the respective shells.

The improved apparatus is designed to remove convoluted roll films from successive containers of the type having a substantially cylindrical shell with an axially parallel mouth which is flanked by two sealing lips and through which the film extends when the container is properly inserted into a photographic apparatus, a pair of washer-like (centrally apertured) end walls engaging the ends of the shell and a film-supporting reel which is confined in the shell between the two end walls and has a core with end portions which are accessible through the respective end walls (at least one end portion of the core normally extends through the central aperture of the adjacent end wall and the reel preferably further comprises two flanges which flank the convolutions of the film in the interior of the shell). The apparatus comprises a gate or other suitable means for positioning successive containers in a predetermined orientation at an opening station, holder means for externally gripping the shell at the opening station at a plurality of locations which are spaced apart from one another, as considered in the circumferential direction of the shell, means for rotating the core of the reel in the container at the opening station including an axially movable mandrel which is in register with the core at the opening station and means for shifting the mandrel axially into torque-transmitting engagement with one end portion of the core at the opening station, and means for expelling the reel from the shell at the opening station. The expelling means includes a reciprocable pusher which is in register with the core at the opening station. The core at the opening station is located between the mandrel and the pusher, one end wall of the container at the opening station is adjacent to the mandrel and the other end wall of such container is adjacent to the pusher. The expelling means further comprises means for shifting the pusher toward and in the axial direction of the mandrel with a force such that the pusher bears against the other end portion of the core and displaces the reel, the one end wall of the container at the opening station and the mandrel with reference to the shell while the shell is gripped by the holder means so that it cannot share the axial movements of the mandrel, of the one end wall, of the reel and of the pusher.

The holder means preferably comprises at least four preferably equidistant grippers in the form of idler rollers with sharp peripheral edges and means for moving the edges of the grippers into and from engagement with the shell at the opening station. The grippers in the form of idler rollers can form an annulus which surrounds one end portion of the shell at the opening station. The means for moving the idler rollers is preferably arranged to move the idler rollers between retracted positions in which the idler rollers are out of contact with the shell at the opening station and extended positions in which the edges of the idler rollers can penetrate into the adjacent portions of the peripheral surface of the shell at the opening station. Each idler roller is preferably rotatable about an axis which is at least substantially parallel to the axis of the mandrel, and the holder means can further comprise means (e.g., screws) for releasably fixing the idler rollers in selected angular positions. The means for moving the idler rollers is preferably designed to move the idler rollers at least substantially radially of the mandrel (e.g., in such a way that each idler roller has a first component of movement in the radial direction of the mandrel and a second component of movement in the circumferential or tangential direction of the mandrel). The means for moving the idler rollers can comprise discrete supports for the idler rollers and means for moving the supports at least substantially radially of the mandrel. For example, the supports can be provided with followers and the means for moving the supports can comprise a cam and means for moving the cam. The cam can include a ring-shaped member which is rotatable about the axis of the mandrel and has a suitably configurated and inclined cam slot for each of the followers. The means for moving the cam can comprise means for rotating the ring-shaped member about the axis of the mandrel.

The apparatus preferably further comprises means for supplying successive containers to the evacuating station by gravity feed along a predetermined path and preferably at right angles to the axes of the shells. The mobile grippers (e.g., idler wheels) of the holder means are adjacent to the path at the opening station, and the means for moving the grippers is designed to move the grippers between retracted positions in which the grippers define a space for reception of one end portion of the shell at the opening station and extended positions in which the grippers hold the one end portion in the space against movement in the axial direction of the mandrel. The mandrel is then designed to move the shell at the opening station axially in the retracted positions of the grippers so that the one end portion of the shell can enter the space between the grippers before the grippers are moved to their extended positions. The supplying means preferably includes a downwardly sloping chute or duct, and the apparatus preferably further comprises a stop for the container at the opening station. The mandrel is arranged to move the container at the opening station against the stop; this results in movement of the one end portion of the respective shell into the aforementioned space which is defined by the grippers of the holder means. The stop is peferably surrounded by the grippers and can be provided with a centering socket for the one end portion of the shell at the opening station.

The means for shifting the mandrel can comprise a relatively small and weak fluid-operated (e.g., pneumatic) motor and the means for shifting the pusher preferably comprises a relatively large and strong fluid-operated (e.g., pneumatic) motor. The mandrel is preferably horizontal or substantially horizontal, and the positioning means can comprise a gate which serves to support the shell at the opening station from below and is movable to a retracted position in which the shell can leave the opening station by gravity as soon as the pusher is disengaged therefrom, i.e., as soon as the pusher is retracted from the opening station. The means for rotating the mandrel in a direction to wind the film onto the core of the reel at the opening station and/or subsequent to shifting of the reel out of the opening station can comprise an elongated gear on the mandrel and a driven gear which mates with the elongated gear in each axial position of the mandrel.

The means for supplying successive containers to the opening station can further include a partition having a circular opening through which the mandrel extends prior to shifting of the pusher in a direction to expel the reel from the shell at the opening station. The pusher shifts the core of the reel and the one end wall of the container at the opening station through such opening so that the reel is disposed at one side of the partition prior and at the other side of the partition subsequent to its expulsion from the shell.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 3:
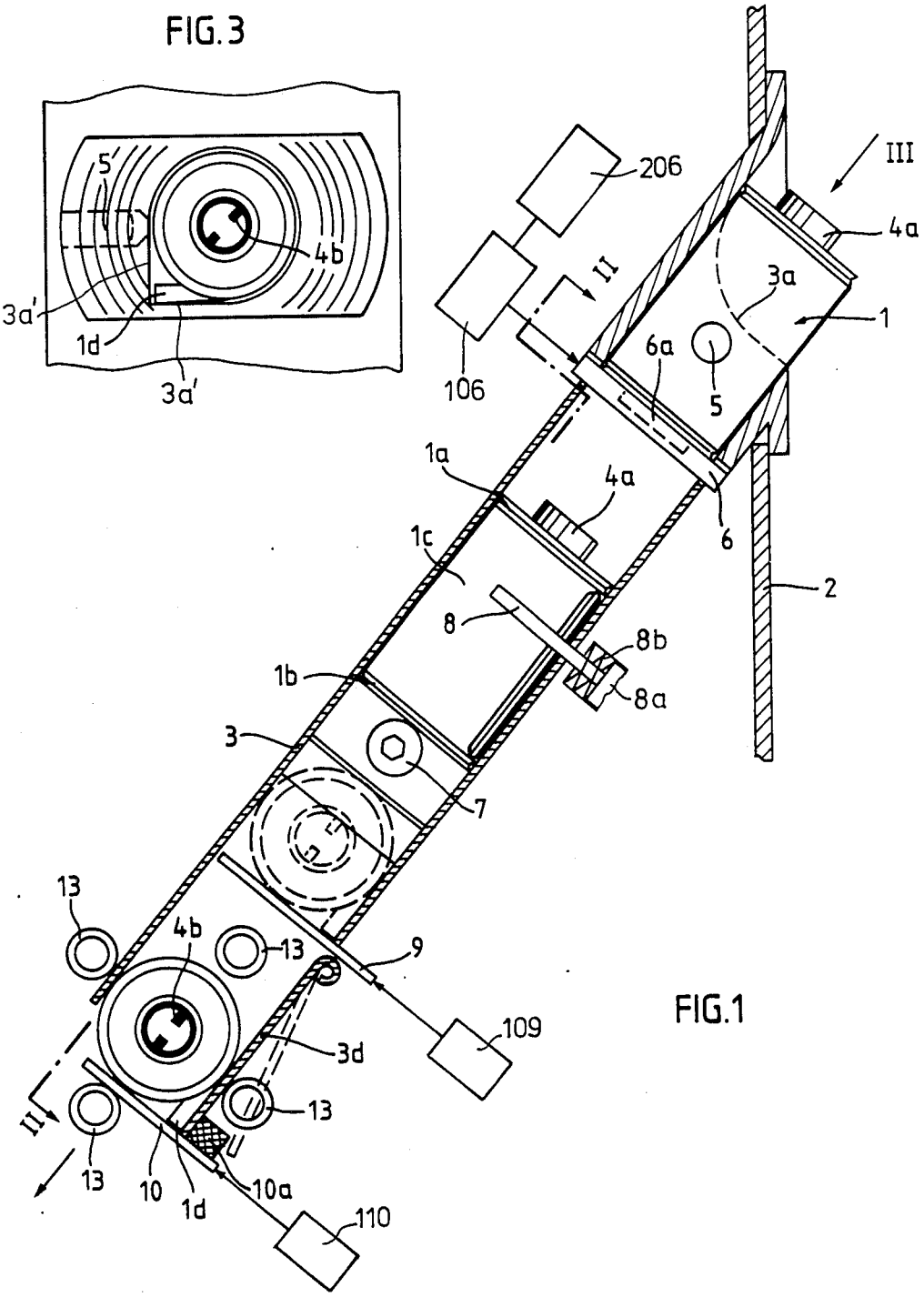
FIG. 1 is a vertical sectional view of the improved apparatus, showing the means for supplying successive containers to the opening station by gravity feed and the grippers of the holder means in retracted positions.
FIG. 3 illustrates the inlet of the supplying means as seen in the direction of arrow III in FIG. 1.

FIG. 1 shows a portion of an apparatus which is used to expel reels 4 (FIG. 5) with convoluted exposed roll film 104 between their flanges 4*b* from substantially cylindrical shells 1*c* of successive containers or cartridges 1. Each cartridge 1 further comprises a mouth 1*d* which is an integral part and is disposed substantially tangentially of the shell 1*c* and two washer-like covers or end walls 1*a* and 1*b* which are sealingly received in the corresponding end portions of the shell.

Figures 2, 4:
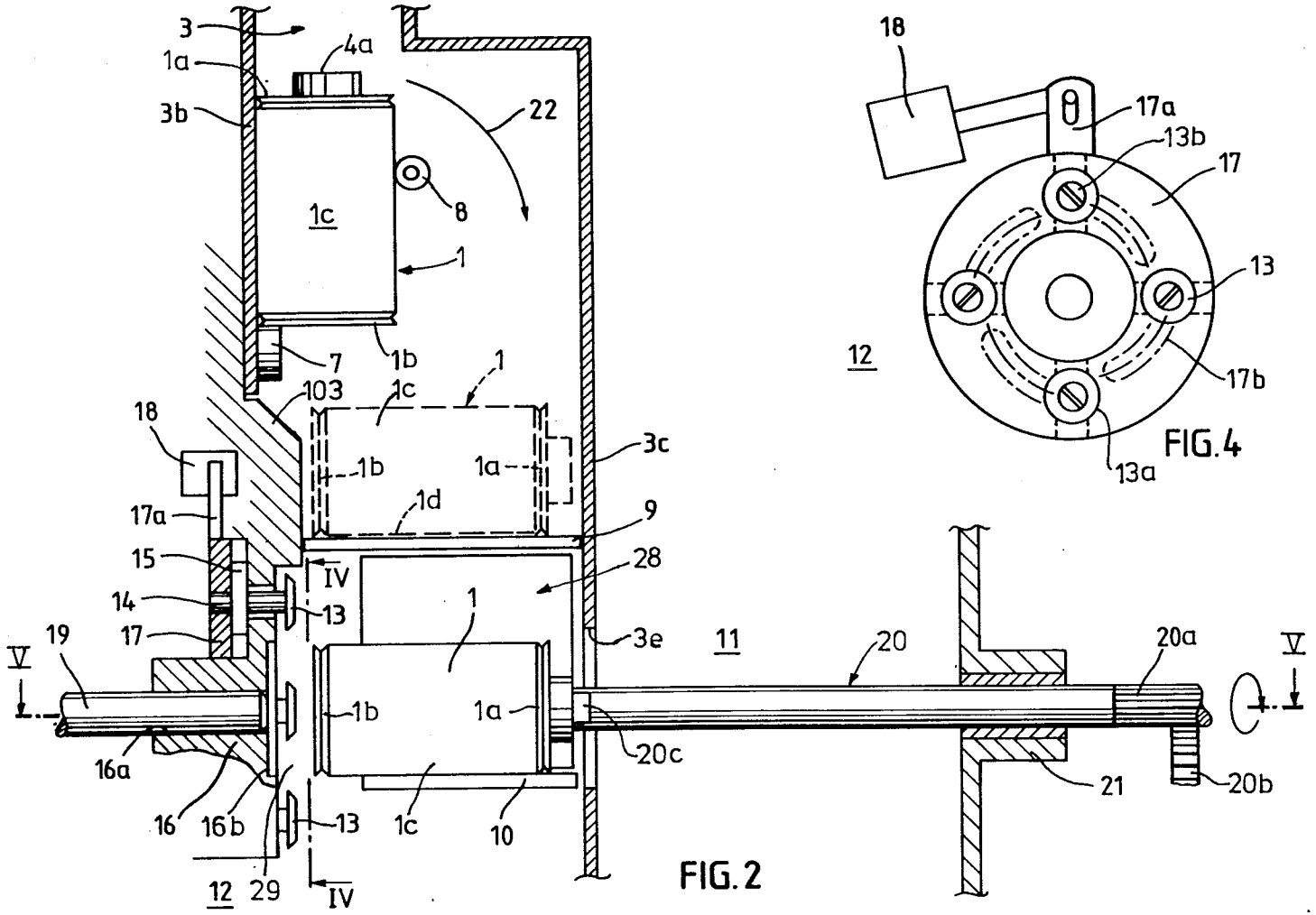
FIG. 2 is a sectional view as seen in the direction of arrows from the line II—II of FIG. 1.
FIG. 4 is a front elevational view of the holder means as seen in the direction of arrows from the line IV—IV of FIG. 2.

The upper portion of FIG. 1 shows a container or cartridge 1 which is properly inserted into the upper end portion of a downwardly sloping chute or duct 3 serving as a means for supplying successive cartridges 1 to an opening station 28 (see particularly FIG. 2). It will be seen that the upper end portion of the core 4*a* of the reel in such cartridge extends upwardly beyond the corresponding end wall 1*a*, and FIG. 3 shows that such end portion of the core 4*a* is hollow and has two internal torque-receiving elements in the form of radially inwardly extending ribs or webs 4*b* which can be engaged by a horizontal mandrel 20 (shown in the lower part of FIG. 2 and in FIG. 5) so as to rotate the reel 4 in a direction to wind the film 104 onto the core 4*a* between the flanges 4*b*. The mandrel 20 has a substantially blade-like front end portion 20*c* which can penetrate into the hollow portion of a core 4*a* at the opening station 28 to engage the respective torque-receiving elements 4*b*. The illustrated cartridges 1 are constructed in such a way that the end portions of their shells 1*c* are provided with corrugations for reception of the marginal portions of the respective end walls 1*a* and 1*b*. However it is equally possible to process in the improved apparatus cartridges of the type wherein the the end walls are connected to the respective shell in a different way. Each end wall has a centrally located aperture for the corresponding end portion of the respective core 4*a*. The material of the shell 1*c* is sufficiently elastic to ensure that the marginal portions of the end walls 1*a* and 1*b* are reliably held in the corresponding corrugations in order to prevent penetration of light into the interior of the cartridge. The lips which consist of felt or another suitable light-intercepting material and are installed in the mouth 1*d* of the shell 1*c* are not specifically shown in the drawing.

The upper end portion of the duct 3 is installed in a suitably configurated opening of an upright wall 2 forming part of the housing of the improved apparatus. The inlet 3*a* at the upper end of the duct 3 is configurated in a manner as shown in FIG. 3, i.e., this inlet is substantially circular but comprises a portion which is bounded by two mutually inclined facets 3*a*′ so as to ensure that successive cartridges 1 can be introduced into the duct 3 only in a predetermined angular position in which the mouth 1*d* of the shell 1*c* in the upper end portion of the duct 3 is adjacent to the facets 3*a*′. The inlet 3*a* diverges laterally as shown in FIG. 3 to form two recesses which permit for engagement of the upper portion of a shell 1*c* in the top portion of the duct 3 by two fingers of one hand for the purpose of extracting or changing the orientation of the respective cartridge 1 so that the mouth 1*d* will be located between the facets 3*a*′. The upper portion of the passage which is defined by the duct 3 is substantially cylindrical (save for the portion which is flanked by the facets 3*a*′), and the curvature of the surface bounding such cylindrical portion of the passage corresponds to the curvature of the external surface of a shell 1*c*. It is clear that the duct 3 can be provided with other suitable means for preventing introduction of cartridges 1 in improper angular positions.

The upper portion of the duct 3 carries a monitoring device 5 which is designed to read information encoded on the shells 1*c* of successive cartridges 1 in order to ascertain whether or not the film in the cartridge is compatible with other films which are to be spliced or otherwise attached to each other end-to-end so as to form an elongated strip or web consisting of a large number of customer films. Such elongated strip or web is thereupon transported into a copying station for the making of prints from selected frames or from all frames of exposed films. The copying station is preceded by a developing station. The construction of the film developing and copying means forms no part of the present invention.

The tip of the monitoring device 5 is closely adjacent to and the curvature of such tip preferably corresponds to the curvature of the adjacent portion of the shell 1*c* in the uppermost portion of the duct 3 so as to ensure that the monitoring device 5 can reliably read the encoded information (normally a bar code) which is provided on each shell and is indicative of the type of photographic film therein.

The lower end portion of a cartridge 1 which is introduced into the duct 3 comes to rest on a retractible gate 6 which serves to prevent penetration of light into the lower portion of the duct and which can be retracted by a pneumatically, electromagnetically or otherwise operated motor 106 of any known design. As can be readily seen in the upper portion of FIG. 1, approximately one-half of the cartridge 1 which rests on the gate 6 is accessible to the fingers of an operator so as to allow for convenient turning or extraction of the cartridge if the latter contains a film which is not compatible with other films which are to be spliced together to form the aforementioned strip or web. For example, the motor 106 for moving the gate 6 between the illustrated operative position and a retracted position can comprise a rotary electromagnet or a pneumatic cylinder and piston unit. The central portion of the gate 6 has a recess 6*a* which is preferably shallow and has a circular outline. Such recess serves to receive a portion of the core 4*a* if the cartridge 1 is inserted into the upper end portion of the duct 3 in inverted position so that the outwardly extending end portion of the core 4*a* extends downwardly and into the recess 6*a*. The force with which the motor 106 can shift the gate 6 to the retracted position is relatively small so that, if the end portion of the core 4*a* extends into the recess 6*a*, the core prevents complete retraction of the gate 6 whereby the motor 106 or a part (indicated at 206) which is associated therewith generates a visible and/or audible signal which indicates to the operator that the orientation of the cartridge 1 is improper and that such cartridge has to be inverted so as to prevent the penetration of the core 4*a* into the recess 6*a*. The motor 106 can comprise a clutch which transmits only a relatively small force and begins to slip when the motor 106 attempts to shift the gate 6 while the end portion of a core 4*a* extends into the recess 6*a*. The utilization of such motor is desirable and advantageous because this ensures that the core 4*a* and/or any other part of the cartridge 1 in the upper portion of the duct 3 is not damaged if the motor 106 is actuated while the end portion of a core 4*a* extends into the recess 6*a*. The means 206 for generating the aforementioned signals in response to the failure of the motor 106 to move the gate 6 to the fully retracted position is of conventional design. The motor 106 is started in response to a signal from the monitoring device 5, i.e., the motor 106 will be actuated only if the film 104 in the cartridge 1 at the upper end of the duct 3 is compatible with the previously introduced films. The monitoring device 5 can comprise a reflection type photocell or any other suitable means which can read the encoded information at the exterior of the shell 1*c*.

That portion of the duct 3 which is located at a level below the gate 6 has a square cross-sectional outline. The length of the sides of such portion of the duct 3 slightly exceeds the diameter of a cartridge 1. The lower part of the just discussed square portion of the duct 3 contains a tilting element 7 in the form of a short cylindrical projection which is affixed to the wall 3*b* of the duct 3 at a distance of approximately one and a half lengths of a cartridge below the gate 6. The tilting element 7 is preferably in register with the lower end portion of the mouth 1*d* of the cartridge 1 which descends in the duct 3 to come to rest upon the top portion of the element 7. The diameter of the tilting element 7 can equal or approximate one-third of the diameter of a cartridge, and the axial length of the element 7 need not exceed one-fifth of the diameter of a cartridge.

As shown in the upper portions of FIGS. 1 and 2, the tilting element 7 cooperates with a retractible barrier 8 in the form of an axially movable pin or stud which is biased to the extended position of FIG. 1 by a pneumatic or electromagnetic motor 8*a* and which is biased to a retracted position by a coil spring 8*b*. The distance between the level of the barrier 8 and the level of the tilting element 7 slightly exceeds half the length of a cartridge 8. When the cartridge 1 is in the process of descending along the wall 3*b* toward and onto the tilting element 7, the barrier 8 is held in the extended position of FIG. 1 so that it extends substantially tangentially of the shell 1*c* and prevents immediate tilting of the cartridge 1 as soon as the latter impinges for the first time upon the eccentrically mounted tilting element 7. The arrangement is preferably such that the barrier 8 is retracted and permits a tilting of the cartridge in the direction which is indicated by the arrow 22 after the cartridge has rebounded (once or more than once) upon initial descent onto the tilting element 7. The pneumatic or electromagnetic motor 8*a* can be replaced with any other suitable means which can move the barrier 8 between the extended and retracted positions. The motor 8*a* is used to hold the barrier 8 in the extended position, and the spring 8*b* is free to expel the barrier 8 from the interior of the duct 3 as soon as the motor 8*a* is deactivated. The width of the duct portion at a level immediately above the tilting element 7 slightly exceeds the axial length of a cartridge 1 so that a cartridge which has come to rest on the element 7 can be tilted through 90° as soon as the barrier 8 is retracted. The position of a cartridge which has been tilted through 90° and has descended onto a second retractible gate 9 in the duct 3 is indicated in FIG. 2 by broken lines. The distance between the right-hand end face of the tilting element 7 and a partition 3*c* of the duct 3 slightly exceeds the axial length of a cartridge 1 in the corresponding portion of the duct so that such cartridge can readily bypass the tilting element 7 as soon as its shell 1*c* has assumed a horizontal or substantially horizontal position. As can be seen in FIG. 2, the wall 3*b* of the duct 3 is located at a level above a wall portion 103*b* which slopes downwardly and to the right immediately below the tilting element 7 and serves to ensure predictable descent of a tilted cartridge onto the gate 9 so that the shell 1*c* and the core 4*a* of such cartridge are maintained in horizontal positions.

The distance between the levels of the tilting element 7 and the second gate 9 preferably equals or at least slightly exceeds the diameter of a cartridge 1. The gate 9 is preferably reciprocable or pivotable in directions toward and away from the upright wall 2 of the housing. The means 109 for reciprocating or pivoting the gate 9 between the extended position of FIG. 2 and a retracted position (in which the gate 9 permits a cartridge 1*c* to descend by gravity and to enter the opening station 28) can comprise an electromagnet. Such moving means can be identical with or analogous to the means 106 for moving the first gate 6.

The means for positioning a cartridge 1 at the opening station 28 comprises a third reciprocable or pivotable gate 10 which supports the shell 1*c* of a cartridge from below, preferably in such a way that the mouth 1*d* of such shell comes to rest against the upper side of the gate 10. This can be seen in the lower portion of FIG. 1. The gate 10 is adjacent to a pivotable side wall or flap 3*d* of the gate 3. Such flap is pivotable about a horizontal axis and its lower end portion is engaged by a projection or sealing element 10*a* of the gate 10. When the gate 10 is retracted in a direction to the right, as viewed in the lower portion of FIG. 1, the flap 3*d* is free to pivot to the open position which is indicated by broken lines. This facilitates gravitational descent of certain portions of cartridges 1 from the opening station 28. When the gate 10 is held in the extended position, it cooperates with the flap 3*d* and with other walls at the lower end of the duct 3 to ensure proper orientation of the cartridge 1 at the opening station 28. The means 110 for moving the gate can comprise an electromagnet with a reciprocable or rotary armature.

As can be seen in FIGS. 1, 2, 4 and 5, the improved apparatus further comprises a holder 12 which is adjacent to the path of gravitational movement of successive cartridges 1 from the gate 9 onto the gate 10 and serves to grip the shell 1*c* of the cartridge 1 at the opening station 28 so that such shell cannot move in the axial direction of the horizontal mandrel 20. The illustrated holder 12 comprises four equidistant grippers 13 in the form of idler rollers having sharp circumferentially extending edges 13*a* (see FIG. 4) which can penetrate, at least slightly, into the external surface of the shell 1*c* resting on the gate 10. The idler rollers 13 are mounted on radially movable supports 15 which have followers 14 extending into arcuate slots 17*b* of a rotary ring-shaped cam member 17 whose axis coincides with the axis of the mandrel 20 and which has a radially extending extension or arm 17*a* coupled to a rotating means 18 in the form of an electromagnet or the like. The idler rollers 13 are readily rotatable on the respective supports 15 about axes which are parallel to the axis of the mandrel 20. Alternatively, the idler rollers 13 can be fixed in selected angular positions by screws 13*b* to be angularly adjusted at selected intervals so as to ensure that the shell 1c of a cartridge 1 at the opening station 28 will be engaged by sharp portions of the edges 13a. The idler rollers 13 define a space 29 which can receive the adjacent end portion of a shell 1c in response to axial movement of the mandrel 20 in a direction to the left, as viewed in FIG. 2. A stop 16 has an axial bore for a pusher 19 which is reciprocable by a relatively large and strong fluid-operated (for example, pneumatic) motor 119. The right-hand end portion of the stop 16 has a centering socket 16b which can receive the adjacent end portion of the shell 1c to ensure that such shell is properly positioned for engagement of the corresponding core 4a with the pusher 19.

The curvature of cam slots 17b in the ring-shaped cam member 17 is such that the idler rollers 13 have components of movement radially of the mandrel 20 as well as in the circumferential direction of the mandrel during rotation of the cam member 17 in a clockwise or counterclockwise direction in order to move the idler rollers between the retracted or idle positions of FIG. 2 and the extended or operative positions in which the edges 13a of such idler rollers engage the adjacent portions of the shell 1c on the gate 10 and reliably hold the shell against axial movement during forward movement of the pusher 19 in a direction toward the mandrel 20.

The partition 3c of the duct 3 has a circular opening 3e which is concentric with the mandrel 20, pusher 19 and shell 1c on the gate 10. The diameter of the opening 3e approximates the outer diameter of the reel 4 and only slightly exceeds the diameters of flanges 4b on the wheel which is to be expelled from the station 28 in response to rightward axial movement of the pusher 19, as viewed in FIG. 2, while the idler rollers 13 engage and hold the shell 1c against axial movement.

The mandrel 20 is rotatable in a bearing 21 which is installed in the housing of the improved apparatus and is reciprocable by a relatively small and weak fluid-operated motor 120 which constitutes a means for shifting the mandrel 20 axially toward and away from the opening station 28. The means for rotating the mandrel 20 in a direction to convolute the film 104 onto the reel 4 at the opening station 28 as well as during and upon completed expulsion from the opening station 28 comprises an elongated pinion 20a which can constitute an integral part of the mandrel and a driven gear 20b which is in mesh with the pinion 20a in each axial position of the mandrel. The blade-like front end portion 20c of the mandrel 20 can enter the hollow end portion of the core 4a at the opening station 28 to engage with the ribs or webs 4b and to transmit torque to the reel 4 in a direction to wind the film 104 onto the core 4a between the flanges 4b. The mandrel 20 further comprises a centering cap 20d (see FIG. 5) which can surround and center the adjacent end portion of the core 4a of the reel 4 at the opening station 28. The axis of the mandrel 20 coincides with the axis of the pusher 19.

Figure 5:
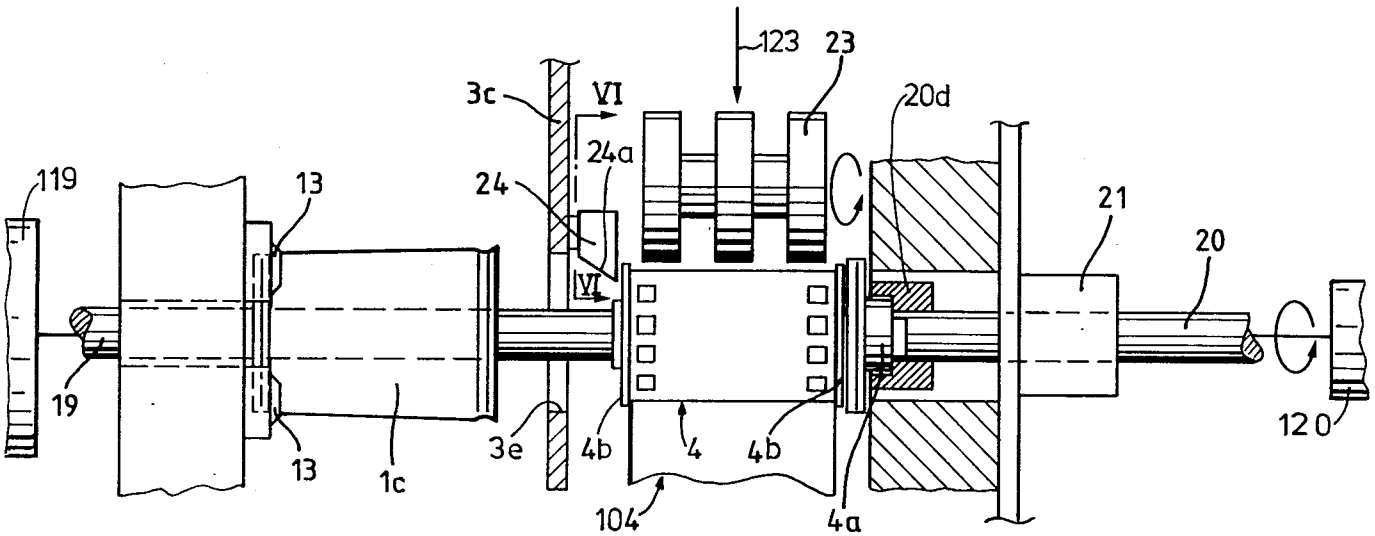
FIG. 5 is a horizontal sectional view as seen in the direction of arrows from the line V—V of FIG. 2 and shows the reel of a container in a position it assumes upon expulsion from the shell at the opening station.

The motor 120 is weaker than the motor 119 so that the mandrel 19 can yield in response to rightward movement of the pusher 19, as viewed in FIG. 5. FIG. 5 shows the reel 4 upon expulsion from the corresponding shell 1c which latter remains at the opening station 28. It will be noted that the reel 4 is moved from one side of the partition 3c, through the opening 3e of such partition, and to the other side of the partition and is held by the pusher 19 and mandrel 20 in a position of axial alignment with such parts. The idler rollers 13 of the holder 12 are held in extended positions so that they prevent the shell 1c from leaving the opening station 28 in response to rightward axial displacement or shifting of the pusher 19. Once the reel 4 is located at the right-hand side of the partition 3c, the film 104 between the flanges 4b can be engaged by a friction wheel 23 which is movable in and counter to the direction indicated by the arrow 123 in order to unwind the film from the reel. The leader of the film 104 is then spliced to the trailing end of the previously unwound customer film so that such films constitute successive portions of the aforementioned elongated strip or web which is convoluted onto a suitable core and is transferred into the developing machine.

Figure 6:
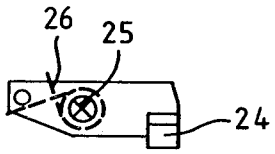
FIG. 6 is a view as seen in the direction of arrows from the line VI—VI of FIG. 5 and shows a spring-biased lever which prevents unwinding of exposed photographic film from the reel during expulsion of the reel from the shell at the opening station.

The improved apparatus further comprises a spring-biased lever 24 which prevents clockspringing of the film 104 during transfer from the station 28 to the unwinding station 11 at the right-hand side of the partition 3c, as viewed in FIG. 5. FIG. 6 shows that the lever 24 is turnable about the axis of a pivot 25 which is mounted on the partition 3c, and the lever is biased in a clockwise direction as viewed in FIG. 6 by a torsion spring 26 so that its downwardly sloping lower end face 24a tends to bear against the outermost convolution of the film 104 on the reel 4 that passes through the opening 3e. The axis of the pivot 25 is parallel to the axis of the mandrel 20. The torsion spring 26 is sufficiently weak to permit the lever 24 to yield when its lower end face 24a rides over the front flange 4b and thereupon over the trailing flange 4b before the lever 24 assumes the angular position which is shown in FIG. 5 and in which it prevents the reel 4 from moving to the left in response to retraction of the pusher 19 through the opening 3e of the partition 3c and out of the opening station 28. The topmost portion of the lower end face 24a of the lever 24 is located at a level above the topmost portions of the flanges 4b of the reel 4 which is held between the mandrel 20 and the pusher 19. When a fresh reel 4 is pushed through the opening 3e, its front flange 4b pivots the lever 24 in a counterclockwise direction, as viewed in FIG. 6, whereupon the lever 24 turns clockwise under the action of the torsion spring 26 to ride over the outermost convolution of the film 104 before it is caused to yield again in response to engagement of its sloping surface 24a by the trailing flange 4b of the reel 4 which has been caused to advance through and beyond the opening 3e.

The gates 6, 9 and 10 serve to control the movements of cartridges on their way toward and to position the cartridges at the opening station 28 as well as to prevent the propagation of light toward the stations 28 and 11. The exact nature of circuitry which synchronizes the movements of various mobile parts including the gates 6, 9, 10, the mandrel 20, the pusher 19 and others forms no part of the invention.

The operation of the apparatus is as follows:

An operator introduces a cartridge 1 into the inlet 3a in the upper portion of the duct 3 in an angular position as shown in FIG. 3, namely so that the mouth 1d is located between the facets 3a' and is held in a predetermined angular position. The longer end portion of the core 4a extends upwardly and beyond the corresponding end wall 1a of the cartridge 1 so that the recess 6a in the gate 6 is empty. If this is not the case, the operator grasps the upper portion of the shell 1c in the inlet 3a and inverts the cartridge prior to reinsertion into the upper portion of the duct 3. The monitoring device 5 scans the information which is encoded on the shell 1a of the cartridge 1 in the upper portion of the duct 3 and generates a signal if the film in the cartridge is not compatible with the previously extracted or expelled films. If the film 104 in the cartridge 1 at the upper end of the duct 3 is compatible with the previously processed films, the monitoring device 5 generates a signal which causes the motor 106 to shift the gate 6 to the open or retracted position. As explained before, such shifting is possible only if the recess 6*a* is empty, i.e., if the shorter end portion of the core 4*a* is located at the lower end of the freshly inserted cartridge.

Once the gate 6 assumes its open or retracted position, the cartridge 1 descends by gravity toward and onto the tilting element 7 while the barrier 8 is held in the extended position of FIG. 1. This prevents immediate tilting of the cartridge in response to initial impact against the tilting elements 7. The delay with which the motor 8*a* retracts the barrier 8 from the duct 3 is selected in such a way that the cartridge 1 can rebound on the tilting element 7 once or more than once to thus ensure that tilting of the cartridge in the direction of arrow 22 shown in FIG. 2 takes place in a predictable fashion and that the cartridge comes to rest on the gate 9 in a horizontal position as indicated in FIG. 2 by broken lines. The area of contact between the tilting element 7 and the underside of the descending cartridge 1 is relatively small, and such area of contact is located at one side of the axis of the cartridge so that the latter exhibits a pronounced tendency to change its orientation in the direction of arrow 22 and to assume a horizontal position in which it is free to descend onto the gate 9 and to bypass the relatively short tilting element 7. The configuration of the upper portion of the tilting element 7 can be such that it extends in part into the customary annular recess at the lower axial end of the cartridge 1 which rests thereon to even more reliably ensure predictable tilting of the cartridge prior to descent onto the gate 9. The aforediscussed configuration of the duct 3 immediately below the tilting element 7 also contributes to predictable guidance of the cartridge which is in the process of descending onto the gate 9. The height of the duct portion between the tilting element 7 and the gate 9 does not suffice to permit any rolling of the cartridge 1 during travel toward and subsequent to impingement upon the gate 9. This ensures that the mouth 1*d* of the shell 1*c* of such cartridge comes to rest on the gate 9, i.e., in a predetermined orientation. The mouth 1*d* also prevents any rolling of the shell 1*c* on impact against the upper side of the gate 9. All in all, the improved tilting arrangement ensures that the cartridge is tilting in the direction of arrow 22 but that it does not turn about its own axis; this ensures predictable engagement between the mouth 1*d* and the gate 9.

The means 109 for retracting the gate 9 can receive a signal with a predetermined delay following retraction of the barrier 8 so that the cartridge 1 which has come to rest on the gate 9 descends onto the gate 10 and is properly positioned between the retracted pusher 19 and the retracted mandrel 20. Retraction of the gate 9 takes place while the mouth 1*d* remains in contact with it to the very last moment so that the orientation of the cartridge does not change and the cartridge simply descends without any angular movement about its own axis. Once the cartridge 1 has come to rest on the gate 10 in such a way that the mouth 1*d* abuts against the upper side of this gate, the motor 120 receives a signal which causes it to shift the mandrel 20 in a direction to the left, as viewed in FIG. 2, whereby its front end portion 20*c* engages the ribs or webs 4*b* of the core 4*a* at the opening station 28 and is ready to transmit torque to the reel 4 as well as to the convoluted film 104 on the reel 4 between the flanges 4*b*. Axial movement of the mandrel 20 in a direction to the left, as viewed in FIG. 2, entails an axial shifting of the cartridge 1 on the gate 10 toward the stop 16 whereby the left-hand portion of the shell 1*c* of such cartridge enters the space 29 and thereupon the socket 16*b* to be properly centered with reference to the retracted pusher 19. The gear 20*b* is driven so that it rotates the mandrel 20 through the medium of the pinion 20*a* whereby the mandrel 20 rotates the reel 4 in a direction to wind the film 104 onto the core 4*a* between the flanges 4*b*. The outermost convolution of the film 104 is in contact with the internal surface of the shell 1*c* at the opening station 28 which entails a tightening of the convolutions of the film in the cartridge. Friction between the outermost convolution of the film 104 and the internal surface of the shell 1*c* need not be excessive but it should suffice to ensure that the diameter of the film is reduced so as to guarantee that the film can pass through the circular opening 3*e* of the partition 3*c* in response to rightward movement of the pusher. 19, as viewed in FIG. 2.

The magnet 18 or other suitable means for rotating the cam 17 in a direction to move the grippers or idler rollers 13 to their extended positions is preferably actuated in automatic response to penetration of a portion of the shell 1*c* into the socket 16*b* whereby the circumferentially extending sharp edges 13*a* of the idler rollers 13 engage the external surface of the shell 1*c* with a substantial force. The number of idler rollers 13 can exceed four and such rollers are preferably equidistant from each other, as considered in the circumferential direction of the shell 1*c*, so as to ensure that the shell is not deformed or is not overly deformed in response to actuation of the electromagnet 18 for the purpose of moving the idler rollers 13 from their retracted to their extended or operative positions. The likelihood of deformation of the shell 1*c* in response to engagement by the edges 13*a* of the idler rollers 13 is reduced due to the fact that such rollers engage the shell 1*c* close to the end wall 1*b* which stiffens the corresponding end portion of the shell and opposes the deforming action of the idler rollers. It has been found that the idler rollers 13 can engage the shell 1*c* with a substantial force without bringing about a deformation which would prevent the left-hand flange 4*b* of the reel 4 in such shell from leaving the shell in response to forward movement of the pusher 19.

In the next step, the motor 119 for the pusher 19 is actuated, e.g., in response to energization of the electromagnet 18 and with a sufficient delay to ensure that the idler rollers 13 properly engage the shell 1*c* at the opening station 28 before the pusher 19 engages the adjacent end portion of the core 4*a* and moves the entire reel 4, with the film 104 thereon, as well as the front end wall 1*a* relative to the shell 1*c* (which is held by the idler rollers 13) so that the reel 4 is transferred to the position which is shown in FIG. 5. The force which is applied by the motor 119 can be readily selected in such a way that the pusher 19 is capable of expelling the front end wall 1*a* from the shell 1*c* of any commercially available cartridge for customer films. This is possible because the idler rollers 13 reliably hold the shell 1*c* against axial movement when the pusher 19 moves toward the mandrel 20 and thereupon causes the mandrel to move axially in a direction to the right, as viewed in FIG. 2, in order to assume the axial position which is shown in FIG. 5 and in which the reel 4 is located at the unwinding station 11 of the improved apparatus.

If desired, the pusher 19 can be caused to rotate in a direction to wind the film 104 onto the respective reel 4. However, this is normally not necessary because the end portion 20*c* of the mandrel 20 can engage with the ribs or webs 4*b* of the core 4*a* to rotate the reel 4 in a direction to wind the film 104 thereon even before the pusher 19 comes into actual contact with the core 4*a* at the opening station 28. Rotation of the core 4*a* during transfer from the station 28 to the station 11 is desirable and advantageous because this ensures that the diameter of the convoluted film 104 is sufficiently small to enable the film to pass through the opening 3*e* as well as that the film can be properly engaged by the friction wheel 23 as soon as it reaches the unwinding station 11.

If desired, the improved apparatus can employ a duct which permits rolling movements of the cartridges 1, at least after tilting by the element 7 in response to retraction of the barrier 8. The rolling movement can be readily determined in such a way that the cartridge 1 which comes to rest on the gate 10 assumes a predetermined angular position which is best suited for expulsion of the reel 4 from its interior. Rolling of cartridges in the interior of the duct is desirable or possible if the duct is relatively long. Proper angular positioning of the cartridge 1 on the gate 10 is desirable and advantageous because this ensures that the idler rollers 13 of the holder 12 do not engage the mouth 1*d* when they are caused to move from the retracted to the extended positions. In other words, the angular position of the mouth 1*d* should be such that, when the mandrel 20 pushes a shell 1*c* at the station 28 into the socket 16*b* of the the stop 16, the corresponding end portion of the mouth 1*d* is located in the space between two neighboring idler rollers 13. This can be reliably achieved in the illustrated duct 3 wherein the cartridge 1 is held against angular movement in the upper portion (at a level above the tilting element 7) as well as in the lower portion during movement from the level of the tilting element 7 onto the gate 9 and thereupon onto the gate 10.

The gate 10 is retracted upon completed transfer of a reel 4 from the station 28 to the station 11, and such retraction of the gate 10 entails a pivoting of the flap 3*d* to the broken-line position of FIG. 1 whereby the aperture for the gravitational descent of the shell 1*c* and end wall 1*b* from the station 28 is sufficiently large to allow for predictable gravitational descent of the shell into a collecting receptacle or the like. The gravitational descent of the shell 1*c* and the end wall 1*b* therein is preceded by retraction of the idler rollers 13 so that the shell is free to leave the station 28. At such time, the next cartridge is preferably located on the gate 9 which opens as soon as the gate 10 returns to the extended position of FIGS. 1 and 2 so that the opening station 28 is ready to receive the fresh cartridge. This ensures that the apparatus can process a large number of cartridges per unit of time.

The unwinding station 11 accommodates a suitable composite housing whose sections can be moved apart so as to permit for movement of the reel 4 out of the station 11. The housing defines a channel and is provided with a suitable lifting or stripping device for the leader of the film 104 at the station 11. Reference may be had to the commonly owned copending patent application Ser. No. 778,611 which fully describes and shows the composite housing at the unwinding station. The friction wheel 23 is set in rotary motion in a direction to unwind the film 104 from the reel 4 at the station 11 as soon as the transfer of the reel from the station 28 to the station 11 is completed. The leader of the film then passes along the aforementioned stripping device which ensures that the leader enters the channel of the housing and is guided along a predetermined path toward and into the splicing station. The exact construction of the splicing mechanism forms no part of the present invention. As mentioned before, such splicing mechanism can be used to affix the leader of an oncoming film to the trailing end of the preceding film so that the films together form portions of an elongated strip or web which is convoluted onto the core of a reel and is transferred into the developing machine.

The unwinding of a film 104 from the reel 4 continues until the trailing portion of the film is partially unwound by the friction wheel 23. Such trailing portion is secured to the adjacent portion of the core 4*a*. The trailing portion is then severed so as to separate it from the core 4*a*, for example, by a knife of the type disclosed in German Pat. No. 22 53 707. Tensioning of the trailing portion of the film 104 in response to nearly complete unwinding of the film can be detected by a suitable sensor which actuates the knife so that the separation of the trailing portion from the core 4*a* takes place automatically as soon as the unwinding of the film is nearly completed.

The reel 4 is released by retracting the mandrel 20 and the pusher 19 by way of the respective motors 120 and 119 so that, during unwinding of the film 104, the reel 4 confined solely by the aforementioned composite housing and is free to descend by gravity and to enter a suitable collecting receptacle, which is not shown in the drawing, as soon as the unwinding operation is completed.

As mentioned before, the number of grippers in the holder 12 can be increased beyond four. It is also possible to reduce the number of grippers below four but this could eventually lead to excessive deformation of relatively thin and soft shells. Therefore, the number of grippers preferably equals or exceeds four. The maximum number of grippers which form part of the holder 12 is limited by the space requirements of the adjacent end portion of the mouth 1*b* of the shell 1*c* at the opening station 28. As explained above, the orientation of the mouth 1*d* is preferably such that its left-hand end portion, as viewed in FIG. 2, enters the space between two neighboring grippers 13 when the mandrel 20 is caused to perform a forward movement so that the left-hand end portion of the shell 1*c* enters the socket 16*b* of the stop 16 at the respective end of the gate 10. It has been found that a holder with four grippers can do the job in connection with the treatment of all commercially available cartridges.

It is also within the purview of the invention to simplify the means for moving the grippers 13 relative to the shell 1*c* at the station 28. For example, if the holder 12 comprises four grippers 13, one pair of such grippers can be mounted on a first support, and the other pair of such grippers can be mounted on a second support so as to simplify the construction and the mode of operation of means of moving the grippers between the extended and retracted positions.

The invention is based on the recognition that the shell of a cartridge can be engaged with a very substantial force if the holder for the shell is properly constructed and if the grippers of such holder engage the shell at a location where the shell can stand pronounced deforming stresses without undergoing deformation such as would prevent expulsion of a reel from its interior. An additional aspect of the invention resides in the recognition that the pusher 19 can readily expel the front end wall 1*a* of any commercially available cartridge if the shell of such cartridge is properly held against axial movement with the reel. It has been found that this can be readily achieved if the grippers 13 engage the adjacent end portion of the shell 1*c* close to the corresponding corrugation for retention of the end wall 1*b* in the adjacent end portion of the shell.

It was also found that the ability of the reel 4 to expel the front end wall 1*a* suffices in all commercially available cartridges irrespective of the manner in which the end wall is secured to the corresponding end portion of the shell. In fact, the reel hardly undergoes any deformation during expulsion of the end wall 1*a* from the corresponding end portion of the shell 1*c* while the pusher 19 moves forwardly to move the reel 4, the end wall 1*a* and the mandrel 20 from the positions of FIG. 2 to the positions which are shown in FIG. 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for removing convoluted roll films from successive containers of the type having a substantially cylindrical shell with an axially parallel mouth, a pair of washer-like end walls engaging the ends of the shell and a film-supporting reel which is confined in the shell between the end walls and has a core with end portions which are accessible through the respective end walls, comprising means for positioning successive containers in a predetermined orientation at an opening station; holder means for externally gripping the shell at said station at a plurality of locations which are spaced apart from one another as considered in the circumferential direction of the shell; means for rotating the core of the reel in the container at said station including an axially movable mandrel which is in register with the core at said station and means for shifting the mandrel axially into torque-transmitting engagement with one end portion of the core at said station; and means for expelling the reel from the shell at said station, including a reciprocable pusher in register with the core at said station, the core at said station being located between said mandrel and said pusher, one end wall of the container at said station being adjacent to said mandrel and the other end wall of such container being adjacent to said pusher, and means for shifting said pusher toward and in the axial direction of said mandrel so that the pusher bears against the other end portion of the core and displaces the reel, the one end wall and the mandrel with reference to the shell at said station while the shell is gripped by said holder means.

2. The apparatus of claim 1, wherein said holder means comprises a plurality of equidistant grippers having sharp edges and means for moving the edges of said grippers into and from engagement with the shell at said opening station.

3. The apparatus of claim 2, wherein the number of said grippers exceeds three.

4. The apparatus of claim 1, further comprising means for supplying successive containers to said station by gravity feed along a predetermined path and at right angles to the axes of the shells, said holder means including a plurality of mobile grippers adjacent to said path and means for moving the grippers between retracted positions in which the grippers define a space for reception of one end portion of the shell at said station and extended positions in which the grippers hold the one end portion in said space against movement in the axial direction of said mandrel, said mandrel being arranged to move the shell at said station axially in the retracted positions of said grippers so that the one end portion of such shell enters said space.

5. The apparatus of claim 4, wherein said supplying means comprises a downwardly sloping duct.

6. The apparatus of claim 4, further comprising a stop for the container at said station, said mandrel being arranged to move the container at said station against said stop and the one end portion of the respective shell being then disposed in said space.

7. The apparatus of claim 6, wherein said stop is surrounded by said grippers.

8. The apparatus of claim 7, wherein said stop has a socket for the one end portion of the shell at said station.

9. The apparatus of claim 6, wherein said stop has means for centering the shell at said station.

10. The apparatus of claim 1, wherein said holder means comprises an annulus of idler rollers having circumferentially extending edges arranged to penetrate into the periphery of the shell at said station, and means for moving said rollers between extended and retracted positions.

11. The apparatus of claim 1, wherein said holder means comprises an annulus of grippers each of which is rotatable about an axis extending in substantial parallelism with the axis of said mandrel, and means for releasably fixing said grippers in selected angular positions.

12. The apparatus of claim 1, wherein said holder means comprises a plurality of discrete grippers and means for moving said grippers substantially radially of said mandrel into and from engagement with the shell at said station, said moving means comprising discrete supports for said grippers and means for moving said supports radially of said mandrel.

13. The apparatus of claim 12, wherein said supports have followers and the means for moving said supports includes a cam and means for moving said cam.

14. The apparatus of claim 13, wherein said cam includes a member which is rotatable about the axis of said mandrel and has a cam slot for each of said followers, said means for moving said cam including means for rotating said member.

15. The apparatus of claim 1, wherein the means for shifting said pusher comprises a fluid-operated motor.

16. The apparatus of claim 1, wherein the means for shifting said mandrel comprises a fluid-operated motor.

17. The apparatus of claim 1, wherein said positioning means comprises a gate which is arranged to support the shell at said station from below and is movable to a retracted position in which the shell can leave said station by gravity upon disengagement of said pusher from such shell.

18. The apparatus of claim 1, wherein said mandrel is at least substantially horizontal.

19. The apparatus of claim 1, further comprising means for rotating said mandrel in a direction to wind the film onto the core of the reel at said station.

20. The apparatus of claim 1, further comprising a partition having a circular opening for said mandrel, said pusher being arranged to move the core and the one end wall of the container at said station through said opening so that the core is transferred from one side to the other side of said partition.

* * * * *